US006216619B1

(12) United States Patent
Musco et al.

(10) Patent No.: US 6,216,619 B1
(45) Date of Patent: Apr. 17, 2001

(54) METHOD FOR STITCHING A WORK PIECE USING A COMPUTER CONTROLLED, VISION-AIDED SEWING MACHINE

(75) Inventors: Richard G. Musco, Lake Worth; Howard L. Shaffer, Hillsboro Beach, both of FL (US)

(73) Assignee: Otabo LLC, Pompano Beach, FL (US)

( * ) Notice: Subject to any disclaimer, the term of this patent is extended or adjusted under 35 U.S.C. 154(b) by 0 days.

(21) Appl. No.: 09/420,083

(22) Filed: Oct. 18, 1999

(51) Int. Cl.[7] ..... D05B 21/00

(52) U.S. Cl. ..... 112/475.05; 12/142 R

(58) Field of Search ..... 112/475.05, 475.19, 112/475.09, 470.01, 470.04, 470.06, 470.07, 102.5; 235/454; 700/138, 136, 137; 12/142 LC, 146 L, 142 R, 146 R

(56) References Cited

U.S. PATENT DOCUMENTS

| | | | | |
|---|---|---|---|---|
| 4,312,282 | | 1/1982 | Dorosz et al. | 112/121.12 |
| 4,639,964 | * | 2/1987 | Binder | 12/142 LC |
| 4,655,149 | | 4/1987 | Szydlek | 112/121.12 |
| 4,784,071 | | 11/1988 | Sadeh et al. | 112/121.12 |
| 4,817,222 | | 4/1989 | Shafir | 12/146 L |
| 4,821,657 | | 4/1989 | Herdeg et al. | 112/121.12 |
| 4,834,008 | | 5/1989 | Sadeh et al. | 112/121.12 |
| 4,932,343 | | 6/1990 | Mardix et al. | 112/121.12 |
| 4,934,292 | | 6/1990 | Mardix et al. | 112/273 |
| 5,094,538 | | 3/1992 | Reedman et al. | 356/376 |
| 5,205,232 | | 4/1993 | Sadeh et al. | 112/262.3 |
| 5,259,329 | | 11/1993 | Reedman et al. | 112/121.12 |
| 5,323,722 | * | 6/1994 | Goto et al. | 112/103 X |
| 5,481,467 | | 1/1996 | Smith et al. | 364/474.28 |
| 5,537,939 | * | 7/1996 | Horton | 112/102.5 X |
| 5,537,946 | | 7/1996 | Sadeh et al. | 112/475.03 |
| 5,777,880 | * | 7/1998 | Bowen et al. | 112/470.06 X |
| 6,032,860 | * | 3/2000 | Brian | 235/454 |

FOREIGN PATENT DOCUMENTS

| | | | |
|---|---|---|---|
| 0 221 163 B1 | 9/1990 | (EP) | D05C/5/04 |
| WO 86/06423 | 11/1986 | (WO) | D05C/5/04 |

* cited by examiner

*Primary Examiner*—Peter Nerbun
(74) *Attorney, Agent, or Firm*—Townsend and Townsend and Crew LLP

(57) ABSTRACT

A method for stitching one work piece to another or for stitching a decorative stitch line along a work piece. In one embodiment, the method includes plotting a line on a first work piece, arranging the first work piece so that at least a portion of the first work piece overlies or abuts at least a portion of a second work piece, and then stitching the first work piece to the second work piece along the plotted line with a computer controlled sewing apparatus having a machine vision system to facilitate stitching along the plotted line. In some embodiments the first and second work pieces are portions of a shoe. Also, in some embodiments the line is plotted on the first work piece in ultraviolet ink.

16 Claims, 2 Drawing Sheets

METHOD FOR STITCHING A WORK PIECE USING A COMPUTER CONTROLLED, VISION-AIDED SEWING MACHINE

BACKGROUND OF THE INVENTION

The present invention relates to a computerized manufacturing process. More specifically, the present invention relates to a computerized method and equipment that enables work pieces, e.g., parts of a shoe upper, to be accurately sewn together or to be sewn with decorative stitching lines, in a vision-aided, computer-guided process.

Traditional shoemaking techniques use a last, which is a solid form, over which a shoe will be made. The last looks somewhat like a foot, but without the toes and other such detail. Traditionally, lasts are hand crafted out of wood by a last "model maker" and then duplicated in volume, including grading for different sizes, on a special lathe, set up specifically for cutting lasts. A different size last (actually a pair of lasts, one for each foot) is needed for each size of shoe. Thus, a line of shoes that is available in half sizes 5–12 and widths narrow, medium, wide for each size, would require 45 pairs of lasts.

From each last, a shoemaker derives a set of paper patterns for each style of shoe to be made. One traditional way of deriving the paper patters is to cover the model size of a last (e.g., a size 9, medium last for men) with narrow (e.g., ½" wide) strips of tape. Once the last surface is completely covered with tape, the shoemaker would then sketch the shoe on the taped surface, showing all details of the shoe. The tape can then be peeled from the last surface in two halves by first cutting down the centerline of the last (toe to heel) and then laying it flat on a flat surface. The two halves are "joined" along their centerlines in the forefoot area.

This flattened tape is called a flattening and is a mechanical way of taking the 3-D surface of the last and translating it to a 2-D surface. The lines of the shoe on the 3-D surface are also shown on this flattening. From these lines, the shoemaker is able to layout all the patterns of the pieces to be cut (from leather and other materials) which will later be sewn together to make up the upper of the shoe. Typically the shoemaker cuts the pieces out of a heavy paper, thus making a set of paper patterns.

Paper patterns not only show the outline of the pieces to be cut, but all the details necessary to aid in production. This includes any perforations (eyelet holes, for example) or markers. A marker is a slot cut in a paper pattern to indicate the position of lines for stitching or guidance in placement of one part on top of another. From the finished set of paper patterns (including all sizes), a shoemaker can make the necessary cutting dies (normally made from band steel) and other templates and tools needed for production.

This shoemaking process has been in use pretty much unchanged since the beginning of the century. Only in the past two decades have there been significant efforts and advances in some of these processes. For one, with the advent of computer driven CAD/CAM systems specific to the footwear industry, much of the pattern work is now done by computer instead of by hand. Paper patterns output from computer CAD/CAM systems can be plotted or cut on computer guided tables, and these patterns used as guides for making steel cutting dies and the other templates and tools necessary for production.

Another area where progress has been made is through the use of computer guided sewing machines. For example, computerized stitching or sewing machines can be employed to sew various pieces of a shoe together. Some computerized stitching machines perform sewing operations along a predetermined path using a sewing program stored in a computer-readable medium. A major drawback to most of these machines is that they are blind, i.e., they cannot see the work piece being sewn. Leather and textiles, basic work pieces in the manufacture of shoes, are flexible materials that may change size and position before and during the sewing process. Thus, occasionally the predetermined sewing path does not match the actual path being sewn resulting in pieces that are subsequently rejected during quality control inspections.

In order to overcome these deficiencies, companies have developed computerized sewing machines with "machine vision" that detects the edges of the work piece being sewn. Machine vision includes the use of cameras and illuminating lights to detect and enhance the detection respectively of the edge of a work piece. With the edge of the work piece identified, the computer controller within the sewing machine can adjust the sewing path as necessary to compensate for misplacement or movement of the work piece or other variations that may otherwise lead to an erroneous sewing path. Edge detection is a complicated process, however, and slight variations in the lighting conditions, work piece characteristics (e.g., color of the leather) or other factors may cause the edge detection software to not function properly. Thus, set up time for an edge detecting machine vision sewing system is lengthy and changes in the work environment may require subsequent adjustments to the machine set up.

The traditional shoe manufacturing techniques described above are well suited for mass production, where long and tedious set-up procedures can be spread out over large production runs for large quantities of shoes with a limited number of sizes. They are not so well suited for the manufacture of custom shoes, where production can be done on a pair-by-pair basis, or at least for much smaller quantities than found in normal mass production. Typically, custom shoes are handmade, relying on skilled artisans and taking several weeks or more to manufacture.

Accordingly, improved shoe manufacturing techniques and equipment are desirable as is an improved method of manufacturing custom shoes.

SUMMARY OF THE INVENTION

The present invention provides improved shoe manufacturing techniques and equipment. The present invention includes a method of operating a computerized, vision-aided sewing apparatus. The method uses the computerized sewing apparatus to stitch a work piece along a predetermined sewing path that generally corresponds to a line that was previously plotted on the work piece. The sewing apparatus uses its machine vision capability to adjust the sewing path in response to the plotted line thus enabling more accurate stitching. This method can be used to stitch one work piece to another or to add decorative stitching to a work piece.

This method of the invention is particularly useful for the manufacture of custom shoes, where many sizes of a given style of shoe (hundreds or even thousands of sizes), in production-run quantities as few as one half pair per size, can be stitched on a vision-aided computer stitching machine, with a minimum of set-up work required. Patterns output from existing CAD/CAM systems can include corresponding data to cut parts to be stitched, to plot lines (on those cut parts) for use by the vision guidance system on a computer stitching machine, and to provide stitch line data for computer guided stitching machines.

In the method of the present invention, the vision-aided sewing machine uses its machine vision system to detect the plotted line and to facilitate stitching along or with reference to the line. In one embodiment, the line plotted on the work piece to be stitched is plotted in ultraviolet ink and the machine vision system for the stitching machine includes ultraviolet lamps to illuminate the plotted line. In another embodiment the line plotted on the work piece to be stitched is a contrasting color ink to the color of the work piece material.

These embodiments and others are described more fully in the Detailed Description below in conjunction with the following figures.

DESCRIPTION OF THE SPECIFIC EMBODIMENTS

Figure 1:
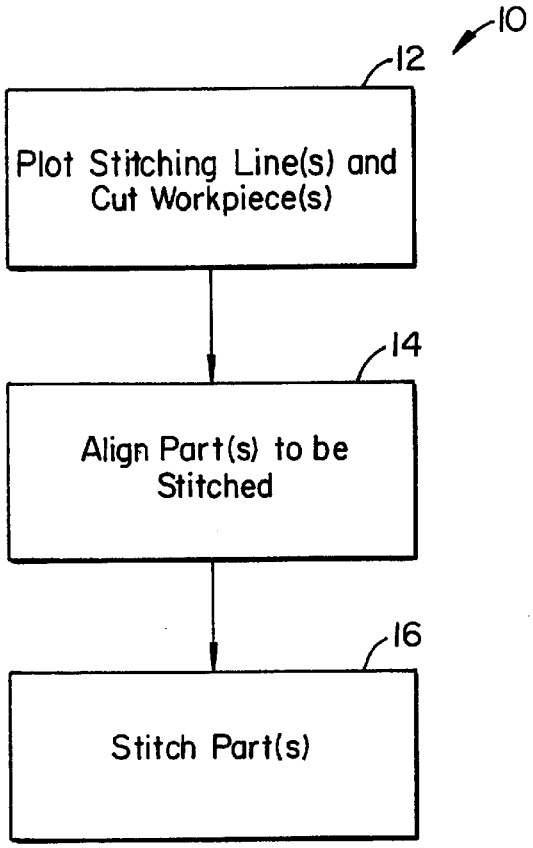
FIG. 1 is a flowchart illustrating one embodiment of the method of the present invention.
Figure 2:
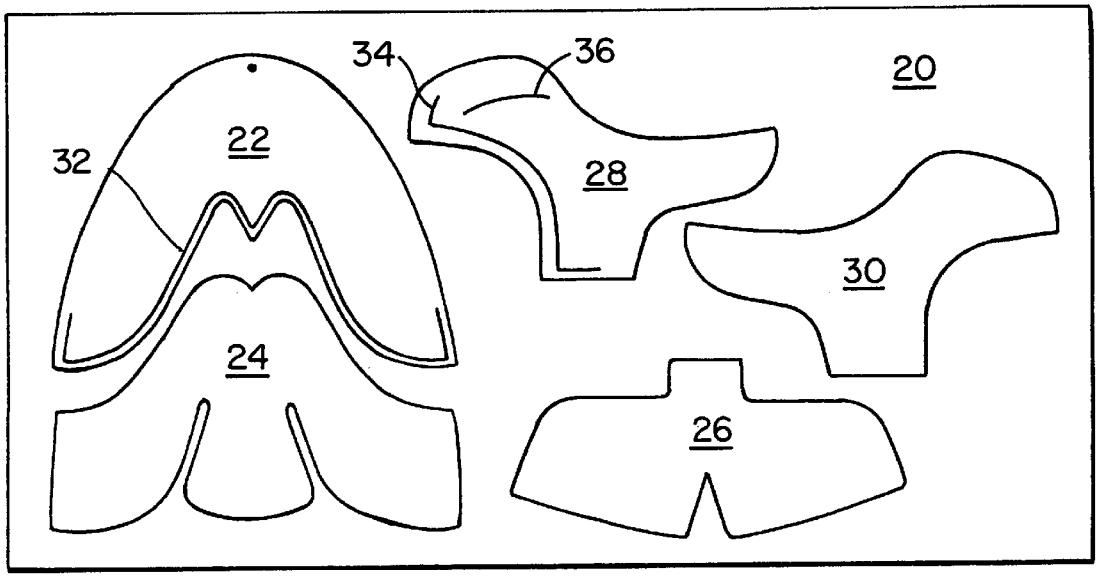
FIG. 2 is a simplified top plan view of a piece of material from which work pieces that are to be subsequently sewn together may be cut.

FIG. 1 is a flowchart showing one embodiment of a computer controlled stitching method (steps 12–16) according to the present invention as implemented in a method of manufacturing custom shoes. Referring to FIG. 1 and FIG. 2, which is a top view piece of a piece of material from which work pieces that are to be subsequently stitched are cut, the method includes plotting a stitching line(s) (lines 32, 34 and 36) on a piece of material 20 (shown in FIG. 2) and cutting material 20 to create a cut work piece(s) (pieces 22 and 28) (step 12). Other work pieces 24, 26 and 30 may also be cut from material 20 and other stitching lines (not shown) may also be plotted thereon. In the example shown in FIG. 2, work pieces 22, 24, 26, 28 and 30 are all pieces of a men's wingtip shoe with piece 22 being the shoe tip, piece 24 the vamp, piece 26 the foxing and pieces 28 and 30 the quarters.

Lines 32, 34 and 36 are plotted from a digitally created pattern stored in a computer-readable medium such as a hard disk drive, and are used as a guide/reference line by the vision system of the computer stitching machine. Custom shoe manufacturing may use hundreds or even thousands of different sizes (and thus patterns) to produce shoes that have a more exacting fit for an individual wearer than mass produced shoes. (Mass produced shoes typically use at least an order of magnitude fewer sizes and more typically only between about 15–45 sizes for men's casual and dress shoes.) Thus, rather than have steel cutting dies made for each size of a style of shoe from a set of paper patterns produced for each size of last, the present invention uses digitally stored, computer generated patterns to guide the operation of the plotter/cutter. In this manner, lines 32, 34 and 36 can be plotted with a very high degree of accuracy.

In one embodiment the digital patterns are created from input files that represent a three dimensional digital representation of lasts ("digital lasts") created in a CAD/CAM system for each size of the custom shoes. As stated above, for a typical custom shoe line there may be over 1000 different sizes thus requiring over 1000 digitized lasts. The digital patterns, one set for each digital last, are created from these three dimensional digital lasts using mathematical flattening algorithms as is known to those of skill in the art. When an individual's foot is digitized it can be compared to the three dimensional digital lasts using a best fit analysis to determine the set of digital patterns that should be referenced by the plotter/cutter during step 12. Once a match is determined, the patterns for the matching last can be downloaded to the plotter/cutter to plot the desired stitching paths on the material to be cut and make appropriate cuts to create multiple work pieces to be stitched together. This process eliminates the need to make steel cutting dies that are otherwise required to cut the work pieces and results in more accurate cuts and more accurate plotted lines than is possible with cutting dies. (Note: It would be financially unfeasible to make and logistically unrealistic to handle, steel cutting dies for a thousand or more sizes of a given style of shoe.)

After the work pieces are cut and the stitching lines plotted, the pieces are appropriately aligned and glued together (step 14). Next, the aligned work pieces are loaded into the computer controlled vision-aided stitching apparatus, e.g., a See-N-Sew stitching machine manufactured by Orisol Ltd., and stitched (step 16). Because the plotted lines (especially an ultraviolet line, when illuminated under a black light as discussed below) are especially clear and provide a high level of contrast between the line and the material it is plotted on, little programming is required to recognize the lines. For the most part, there is one "standard" light setting for all sizes and all materials, when "capturing" or trying to recognize a plotted ultraviolet line. However, under edge recognition vision guided stitching systems, extensive programming and manipulation of the various lighting parameters may be required to "capture" a distinct line for each size of a shoe style and for each material or material color (even for the same size shoe pattern).

In one embodiment stitching is done by following a predetermined stitching path that is generally aligned with, or offset from, plotted stitching line(s) (lines 32, 34 and 36). The predetermined stitching path represents the expected location of the desired stitching line and can be output from the CAD/CAM pattern file. The stitching apparatus uses its machine vision to correct the stitching path as necessary to better follow the actual plotted stitching line. The machine vision can be used by scanning the work piece prior to stitching to create a data file representative of the stitching line and then modifying the data file representing the predetermined stitching path based on a comparison of this data file to the stitching path data file. Alternatively, the machine vision can be used to detect the plotted line during the stitching operation and modifying the stitching path in real time if it is determined that the path does not exactly follow the plotted line. In still another embodiment, the predetermined stitching path can be represented by general instructions such as start stitching at the intersection of stitching lines A and B, stitch along line B to within 3 mm of a stitch line C that intersects line B and then stitch 3 mm offset from line C until the end of the line. Having been so described, such programming is within the capabilities of a person of skill in the art.

As previously mentioned, all vision-aided sewing machines known to the inventors use edge detection routines to follow the stitching path and adjust/correct for deviations that may be required in the path. In contrast, the present invention uses the machine vision capability of the sewing machine to follow a plotted line. Having the machine vision sewing machine focus on the plotted line as opposed to an edge of a work piece 22 and 28 greatly simplifies the vision-assisted stitching operation and increases the accuracy of the operation. Previous computer controlled machine vision sewing machines required numerous lights placed at a variety of angles to maximize the ability of the machine to detect the work piece edge. Edge detection is a complicated process, however, and slight variations in the lighting conditions, work piece characteristics (e.g., color of the leather) or other factors may cause the edge detection software to not function properly, and may require further programming and manipulation.

In contrast, programming the computer controlled, vision-aided sewing machine to follow lines such as lines 32, 34 and 36 plotted in step 12 is relatively simple. Lines 32, 34 and 36 should be plotted in an ink having a high contrast with respect to the work piece material. For example, a black ink line provides excellent contrast on a light colored work piece. Similarly, a white ink line provides good contrast on a dark colored work piece. Certain embodiments of the present invention, however, plot line 32, 34 and 36 using ultraviolet ink.

In order to detect lines plotted in ultraviolet ink in these embodiments, the computer controlled machine vision sewing machine includes ultraviolet lamps instead of standard light bulbs that may be used to detect other plotted lines. Certain embodiments also include a mechanism to block ambient light from the stitching area (e.g., draping a dark curtain around the stitching area). The present inventors have found that one (1) ultraviolet light source, using a high pressure 100 watt mercury vapor short arc lamp with band-pass filters to permit the transmission of ultraviolet light while blocking most of the visible light, and outfitted with two (2) flexible liquid filled light guides to deliver the light from the lamp to the stitching area, placed in a See-N-Sew stitching machine manufactured by Orisol Ltd. can be used in place of twenty (20) or more regular light bulbs recommended by the manufacturer for use in edge detection.

In order to better appreciate the difference in programming of the vision-aided stitching machine afforded by the present invention, consider one embodiment of the present invention where the vision-aided stitching machine is a Sew-N-See stitcher manufactured by Orisol. A See-N-Sew stitching machine operated without the benefit of the present invention includes more than twenty (20) light bulbs positioned in two (2) layers of circles above the stitching area. These two (2) layers are in fact arranged in three (3) different configurations, which the operator has to choose from when "programming" the machine's lighting. These three (3) configurations include an all bottom ring; an all top ring and a combination of lights from the top and bottom rings. Aside from selecting one of these three (3) configurations, the operator also decides whether to turn on or turn off individual lights in the configuration chosen.

It is up to the machine operator to "program" these lights for each frame taken by the vision system. There may be something in the neighborhood of fifty (50) or more frames taken for a given stitching program. That is, to stitch the parts a typical pallet, there are more than fifty (50) frames captured by the vision system. The operator must "program" the lighting conditions for each of these fifty-plus (50+) frames, one-by-one. By "programming", the operator must determine which configuration of lighting to use and then which lights are turned ON and which are left OFF, with the intent to create the best lighting direction to accent the edge of the material for detection of that edge for each and every frame. In addition to this, the operator must adjust the intensity of the light for each frame. For the Orisol machine, the intensity of the light is really the opening of the camera aperture.

It is not unusual for an operator to spend a minute or more on each frame. Also, it is normal to have to come back, after doing "dry-run" testing of a programmed lighting, and have to make adjustments to lighting again, frame by frame addressing any problems that may show up in the edge detection process.

In addition to all the adjustments noted above, the operator must decide on one of three (3) different edge detection algorithms to use as part of the lighting adjustment for each frame. These algorithms include: shadow; white; or contrast. The SHADOW algorithm detects the edge when going from light to dark; the WHITE algorithm detects the edge between dark and light; and the CONTRAST is like WHITE but with some subtleties on how and where the light comes from. Once the operator decides on the algorithm, the programming is input into the stitching machine and the machine is ready for use.

When operated according to the method of the present invention, the twenty-plus (20+) bulbs of the See-N-Sew machine are removed. In their place is positioned one (1) light source that feeds light to the workplace via two (2) light guides. During line detection the light is kept always ON, it is not necessary to change the intensity and the algorithm can be set to shadow. Changes to this program are not necessary on a frame-by-frame bases.

In one specific embodiment used to manufacture leather shoes, the plotting/cutting of step 12 is performed at a cutting table manufactured by Zund Corporation (model LC1800). The cutting table is equipped with over head projectors that project the patterns onto material 20. This allows an operator to move the projected parts with an input device such as a mouse to avoid including scratches, scars or other defects in the material within work pieces 22, 24, 26, 28 and 30. The operator also may move the projected parts in order to get the best yield from a given piece of material 20. The cutting head of the Zund plotting/cutting table includes four (4) separate tools: an oscillating knife that cuts the material; a pen that plots lines; and two routers that punch different size holes in the material for alignment and/or for decorative purposes. Having four tools on this table enables the table to plot lines 32, 34 and 36 and cut work pieces 22 and 28 from the same set of digital patterns as part of a single continuous operation.

After plotting/cutting step 12 but prior to aligning the work pieces for stitching in this embodiment, each work piece is first split on a special designed band saw to a predetermined thickness and then skived. The skiving operation bevels the edges of the work pieces where they overlay another piece and is done on a computer controlled machine manufactured by Fortuna, a German company. The band saw used in this embodiment is also manufactured by Fortuna. Typically the leather work pieces being stitched in this embodiment are split to a thickness of at least 1.0 mm, although the desired thickness is dependent upon the style of shoe and is not dictated by any stitching criteria or other requirements.

Figure 3:
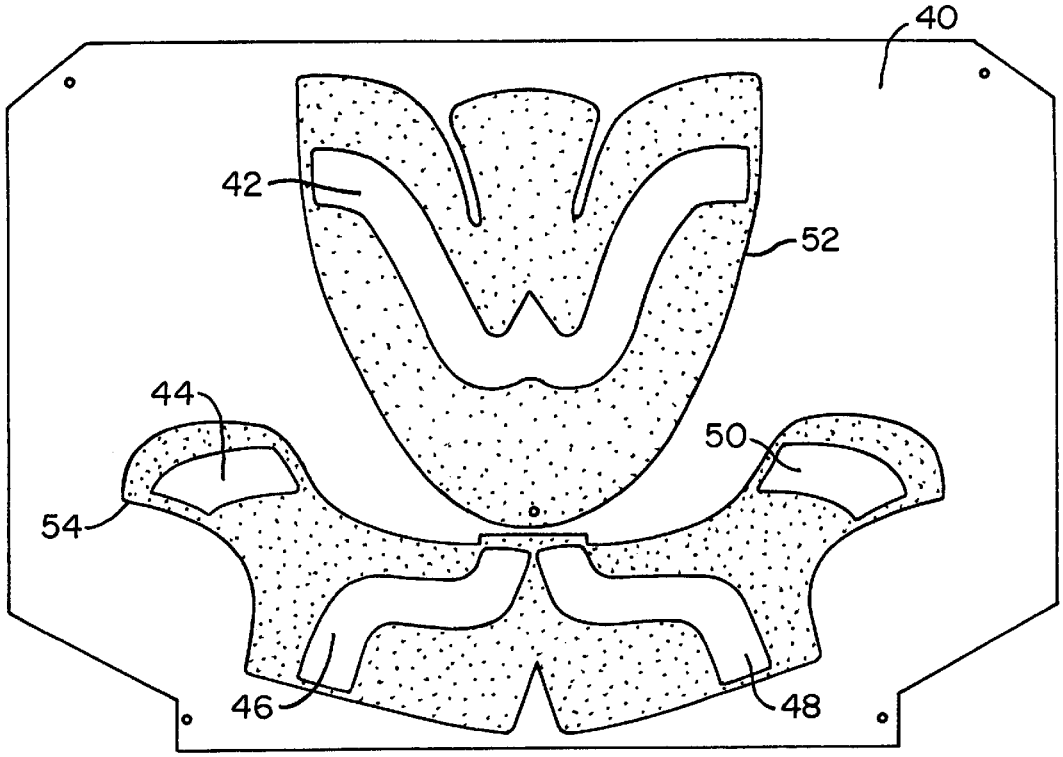
FIG. 3 is a top plan view of a base that may be used to facilitate the alignment of the work pieces cut from the material shown in FIG. 2 prior to being stitched according to the method of the present invention.
Figure 4:
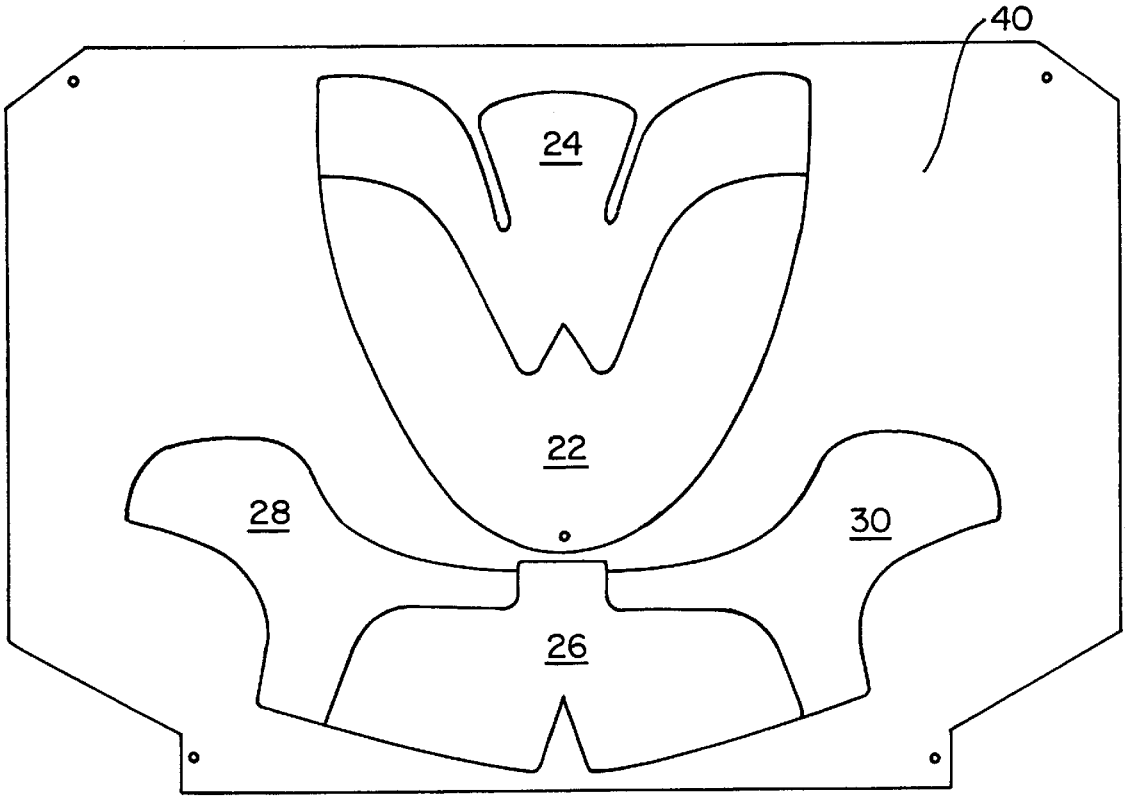
FIG. 4 is a top plan view of the base shown in FIG. 3 having the work pieces cut from the material shown in FIG. 2 aligned thereon.

Work pieces 22, 24, 26, 28 and 30 are then aligned on a cardboard base 40, using the plotted lines which outline the positions of the work pieces (see FIG. 3). The individual pieces are held in place on the cardboard base 40 by a water-based cement which is applied to areas 52 and 54 (shaded areas). Base 40 includes windows 42, 44, 46, 48 and 50 in areas where the work pieces will be stitched. Once all the work pieces are aligned (see FIG. 4), base 40 is placed in the pallet, positioned correctly by means of four (4) punch holes in the four (4) corners of base 40, and the pallet is moved to the computer controlled vision guided stitching machine for stitching.

Having described the present invention with respect to the manufacture of one particular style of custom shoes, a person of skill in the art will recognize that the invention has much broader applicability. For example, the invention may be used to produce any style and type of shoe including shoes with far fewer sizes than custom shoes. Additionally, the present invention may be used to stitch work pieces other than those used for the assembly of shoes. For example, the invention may be used to stitch purses, jackets, gloves and other leather goods and may be also used to stitch similar goods made of synthetic materials and materials other than leather. Also, the present invention may be used to add decorative stitching to a work piece as opposed to stitching two separate work pieces together.

Furthermore, the invention has been illustrated with specific embodiments by way of example only. A person of skill in the art will recognize that many alternative and equivalent methods of practicing the present invention exist. For example, step 16 is illustrated as stitching various work pieces together using a See-N-Sew computer stitching machine manufactured by Orisol Ltd. Other computer controlled, vision-aided stitching machines can be used to sew the work pieces in step 16 or other appropriate machines can be specifically manufactured for this step. A vision-aided stitching machine (or a stitching machine having a machine vision system) within the context of the present invention refers to any machine that can detect the presence and position of a plotted line on the work piece being stitched. Similarly, other methods of plotting the stitching lines, cutting the work pieces (e.g., with a water jet) and aligning the work pieces can be used. Also, the present invention can be used in the manufacture of shoes from digital patterns that are generated from physical rather than digital lasts. As another example, the predetermined and/or actual stitching path may be offset from the plotted line by a set distance, e.g., 1 mm, rather than correspond directly to the line. The present invention is only intended to be limited by the claims listed below.

What is claimed is:

1. A process for manufacturing shoes, the process comprising:

using a computer controlled apparatus to plot a line on a piece of material to be cut and cut a first work piece from said material according to a predetermined pattern stored in a computer-readable medium;

arranging said first work piece so at least a portion of the piece overlies or abuts at least a portion of a second work piece; and using a computer controlled sewing apparatus to stitch said first work piece to said second work piece along a programmed sewing path that corresponds generally to the plotted line, wherein said computerized sewing apparatus includes a machine vision capability enabling it to adjust its sewing path in response to the plotted line.

2. The process of claim 1 wherein said line is plotted in ultraviolet ink.

3. The process of claim 1 wherein said first and second work pieces are parts of a shoe.

4. The process of claim 1 wherein said first work piece has a thickness of at least 1.0 mm.

5. A process for manufacturing shoes, the process comprising:

digitizing a pair of feet with a scanning device to create a digitized data file and comparing said digitized data file to a plurality of digitized lasts using a best fit algorithm to select a best matching digital last;

using a computer controlled apparatus to plot a line on a piece of material to be cut and cut a first work piece from said material according to a predetermined pattern stored in a computer-readable medium, wherein said predetermined pattern is generated from said best matching digital last;

arranging said first work piece so at least a portion of the piece overlies or abuts at least a portion of a second work piece; and using a computer controlled sewing apparatus to stitch said first work piece to said second work piece along a programmed sewing path that corresponds generally to the plotted line, wherein said computerized sewing apparatus includes a machine vision capability enabling it to adjust its sewing path in response to the plotted line.

6. The method of claim 5 wherein said line is plotted in ultraviolet ink and said machine vision system includes ultraviolet lights.

7. The method of claim 5 wherein said first work piece has a thickness of at least 1.0 mm.

8. The method of claim 5 wherein:

said predetermined path is stored in a first data file;

said machine vision system scans said first work piece to create a second data file including data representing the plotted line; and said computer controlled sewing machine references both said first and second data files to stitch said first work piece to said second work piece.

9. A process for manufacturing shoes, the process comprising:

using a computer controlled apparatus to plot a line on a piece of material to be cut and cut a first work piece from said material according to a predetermined pattern stored in a computer-readable medium;

arranging said first work piece so at least a portion of the piece overlies or abuts at least a portion of a second work piece; and using a computer controlled sewing apparatus to stitch said first work piece to said second work piece along a programmed sewing path that corresponds generally to the plotted line, wherein said computerized sewing apparatus includes a machine vision capability enabling it to adjust its sewing path in response to the plotted line and wherein:

said computer controlled sewing apparatus is programmed to stitch along a predetermined path stored in a first data file, said predetermined path corresponding generally with the plotted line;

said machine vision system scans said first work piece to create a second data file including data representing the plotted line; and said computer controlled sewing machine references both said first and second data files to stitch said first work piece to said second work piece.

10. A process for manufacturing shoes, the process comprising:

using a computer controlled apparatus to plot a line on a piece of material to be cut and cut a first work piece from said material according to a predetermined pattern stored in a computer-readable medium;

arranging said first work piece so at least a portion of the piece overlies or abuts at least a portion of a second work piece; and using a computer controlled sewing apparatus to stitch said first work piece to said second work piece along a programmed sewing path that corresponds generally to the plotted line, wherein said computerized sewing apparatus includes a machine vision capability enabling it to adjust its sewing path in response to the plotted line wherein:

said computer controlled sewing apparatus is programmed to stitch along a predetermined stitching path stored in a first data file, said predetermined path corresponding generally with the plotted line;

said machine vision system is used to detect said plotted line while said sewing machine is stitching along said predetermined path; and said predetermined stitching path can be altered in response to detecting said plotted line.

11. The process of claim 1 wherein said first work piece is arranged so that at least a portion of the piece overlies the second work piece.

12. A process for manufacturing shoes, the process comprising:

using a computer controlled apparatus to plot a line on a piece of material to be cut and cut a first work piece from said material according to a predetermined pattern stored in a computer-readable medium;

splitting and skiving said first work piece;

thereafter, arranging said first work piece so at least a portion of the piece overlies at least a portion of a second work piece; and using a computer controlled sewing apparatus to stitch said first work piece to said second work piece along a programmed sewing path that corresponds generally to the plotted line, wherein said computerized sewing apparatus includes a machine vision capability enabling it to adjust its sewing path in response to the plotted line.

13. The process of claim 1 wherein said programmed sewing path is offset from said plotted line.

14. A method for attaching a first work piece to a second work piece, said method comprising:

using a computer-controlled apparatus to plot a line on a piece of material to be cut, wherein said line is plotted from a pattern stored in a computer-readable medium;

using a computer-controlled apparatus to cut said first and second work pieces from said material such that said first work piece includes at least a portion said plotted line, wherein said first and second work pieces are cut from a pattern stored in a computer-readable medium;

aligning said first work and second work pieces on a base such that said first work piece partially overlies or abuts said second work piece;

placing said base in a pallet in preparation for stitching said first work piece to said second work piece; and using a computer controlled sewing apparatus to stitch said first work piece to said second work piece to create a combined work piece, wherein said sewing apparatus stitches along a programmed sewing path that corresponds generally to said plotted line and is stored in a computer-readable medium and wherein said computerized sewing apparatus includes a machine vision capability enabling it to deviate from said sewing path in response to the plotted line.

15. The method of claim 14 wherein said combined work piece is incorporated into a shoe.

16. The method of claim 15 wherein said first work piece has a thickness of at least 1.0 mm.

* * * * *